US009837048B2

(12) United States Patent
Croxford et al.

(10) Patent No.: US 9,837,048 B2
(45) Date of Patent: Dec. 5, 2017

(54) METHOD OF AND APPARATUS FOR PROCESSING DATA FOR A DISPLAY

(71) Applicant: ARM Limited, Cambridge (GB)

(72) Inventors: Daren Croxford, Cambridge (GB); Sean Tristram Ellis, Farnham (GB)

(73) Assignee: Arm Limited, Cambridge (GB)

( * ) Notice: Subject to any disclaimer, the term of this patent is extended or adjusted under 35 U.S.C. 154(b) by 73 days.

(21) Appl. No.: 14/682,321

(22) Filed: Apr. 9, 2015

(65) Prior Publication Data

US 2015/0310791 A1 Oct. 29, 2015

(30) Foreign Application Priority Data

Apr. 17, 2014 (GB) ..... 1406976.9

(51) Int. Cl.

| | |
|---|---|
| ***G09G 5/10*** | (2006.01) |
| *G09G 3/34* | (2006.01) |
| *G09G 5/393* | (2006.01) |

(52) U.S. Cl.

CPC ..... *G09G 5/10* (2013.01); *G09G 3/34* (2013.01); *G09G 5/393* (2013.01); *G09G 2320/0626* (2013.01); *G09G 2340/02* (2013.01); *G09G 2350/00* (2013.01); *G09G 2360/144* (2013.01); *G09G 2360/16* (2013.01)

(58) Field of Classification Search

None

See application file for complete search history.

(56) References Cited

U.S. PATENT DOCUMENTS

2002/0145611 A1* 10/2002 Dye ..... G09G 5/14 345/543

2008/0218467 A1 9/2008 Huang

FOREIGN PATENT DOCUMENTS

WO WO2012/040263 3/2012

OTHER PUBLICATIONS

European Search Report dated Nov. 14, 2014, GB Patent Application GB1406976.9.

"DBS4video: Dynamic Luminance Backlight Scaling based on Multi-Histogram Frame Characterization for Video Streaming Application," Martino Ruggiero, Andrea Bartolini, Luca Benini, University of Bologna, DEIS via Risorgimento 2, 40133 Bologna, Italy.

(Continued)

*Primary Examiner* — Michelle Chin

(74) *Attorney, Agent, or Firm* — Vierra Magen Marcus LLP

(57) ABSTRACT

A data processing system 30 includes a CPU 33, a GPU 34, a video processing engine (video engine) 35, a display controller 36 (or an image processing engine) and a memory controller 313 all having access to off-chip memory 314.

A frame to be displayed is generated by, for example, being appropriately rendered by the GPU 34 or video engine 35. The display controller 36 (or the image processing engine) then performs display modifications, such as luminance compensation, on the frame to provide an output frame for display.

The display controller 36 (or the image processing engine) also provides display modification information (such as determined luminance compensation parameters) to the GPU 33 and video engine 34. The display modification information is then used to modify the data that is generated for a frame to be displayed.

18 Claims, 9 Drawing Sheets

(56) References Cited

OTHER PUBLICATIONS

"DLS: Dynamic Backlight Luminance Scaling of Liquid Crystal Display," Naehyuck Chang, Member, IEEE, Inseok Choi, and Hojun Shim, Student Member, IEEE.
"An Adaptive Algorithm of Local Dimming for Liquid Crystal Displays," Xiaobing Zhang, Xin Liu, Bo Liu, Jianghong Han, and Huaxia Wu, TELKOMNIKA, vol. 10, No. 7, Nov. 2012, pp. 1862-1868, e-ISSN: 2087-278X.
Greef, et al., "Adaptive dimming and Adaptive Boosting Backlight Technologies for LCD-TV systems," Nov. 14, 2007, EE Times, http://www.eetimes.com/document.asp?doc_id=1273777.

* cited by examiner

METHOD OF AND APPARATUS FOR PROCESSING DATA FOR A DISPLAY

BACKGROUND

The technology described herein relates to a method of and an apparatus for processing frames for provision on an electronic display.

It is common for electronic devices, such as mobile phones, and for data processing systems in general, to include some form of electronic display screen, such as an LCD panel. To display an image on the display, the pixels (picture elements) or sub-pixels of the display must be set to appropriate colour values. This is usually done by generating and storing in memory a frame of data to be displayed which indicates, for each pixel or sub-pixel, the colour value to be displayed.

Many electronic display screens such as LCD panels, for example, use a backlight to illuminate the screen for viewing. However, it is known that using a backlight is significantly burdensome on an electronics device's total power consumption. To reduce the power consumption of the backlight of a display screen, the intensity (absolute brightness) of the backlight is reduced, as it is known that the intensity of the backlight is proportional to its power consumption.

An issue with lowering the backlight intensity is that it also reduces the luminance (brightness) of the image being displayed, compared to the luminance at which the image was intended to be displayed.

Various methods have accordingly been developed to optimise the display when dimming the backlight. One such method is called "luminance and backlight scaling", which involves scaling (modifying) the luminance of the image itself to compensate for dimming the backlight.

Backlight and luminance scaling operation typically involves analysing the frame buffer data (e.g. by use of a histogram) to determine an optimum backlight dimming factor and luminance scaling parameters.

Luminance and backlight scaling includes a method called "luminance compensation" which involves recovering at least some of the image luminance that is lost when dimming the backlight by increasing the luminance of the image with respect to a high threshold value.

Other terms for luminance compensation include Brightness Compensation and Image Compensation. For convenience the term luminance compensation will be used herein, but it will be understood that this is intended to include and encompass all equivalent terms and techniques.

FIGS. 1*a* and 1*b* illustrate the general principles behind luminance compensation operation.

FIG. 1*a* shows an image 11 that is being displayed on a display and a histogram 12 showing the density distribution 13 of the display sub-pixels across all of their possible luminance values. In this example, the backlight is set at 100% intensity and luminance compensation is not used. (As can be seen in FIG. 1*a*, an 8-bit value (corresponding to 256 shades of luminance) is used for each sub-pixel.)

FIG. 1*b* shows the same image 11 and corresponding histogram 15 as that of FIG. 1*a*, except that in the example of FIG. 1*b* the backlight intensity is reduced to 70%. As can be seen in FIG. 1*b*, in order to compensate for the image luminance that is lost when dimming the backlight, the luminance values of the sub-pixels have been boosted (e.g. by applying an appropriate transformation function to the original frame buffer data). This is reflected by FIG. 1*b* which shows that the density distribution 14 of the display sub-pixels is concentrated at higher luminance values.

Luminance and backlight scaling may also include a method called "image enhancement", which involves modifying the frame buffer data so as to increase the contrast of the image when the backlight is dimmed. Image enhancement typically involves applying a transformation function to the original frame buffer data so as to remap the luminance of the pixels or sub-pixels with respect to a high and low threshold value.

Other terms used for image enhancement include Contrast Enhancement, Histogram Equalisation and Histogram Stretching. For convenience the term image enhancement will be used herein, but it will be understood that this is intended to include and encompass all equivalent terms and techniques.

FIG. 2 illustrates an exemplary data processing system with luminance and backlight scaling operation.

As shown in FIG. 2, the data processing system includes a central processing unit (CPU) 23, a graphics processing unit (GPU) 24, a video engine 25, a display controller 27, and an image processing engine such as a luminance and backlight scaling engine 26 that communicate via an interconnect 212 in a system-on-chip (SoC) arrangement 21. The CPU, GPU, video engine, display controller and luminance and backlight scaling engine also have access to off-chip memory 211 for storing, inter alia, frames, via a memory controller 210.

The system also includes a display arrangement 22, comprising a backlight 28 and a display 29. The luminance and backlight scaling engine 26 sets the brightness of the backlight 28, and the display controller 27 provides output frames for display to the display 29.

When a frame is to be displayed, the GPU 24 and/or video engine 25 will, for example, generate a frame for display which will then be stored, via the memory controller 210, in a frame buffer in the off-chip memory 211.

When the frame is to be displayed, the luminance and backlight scaling engine 26 will then read the frame from the frame buffer and analyse the frame buffer data (e.g. by use of a histogram) to determine an optimum backlight dimming factor and dynamic luminance scaling parameters.

Following this determination, the luminance and backlight scaling engine 26 will modify the frame buffer data so as to generate a modified, luminance scaled output frame for display. The luminance and backlight scaling engine 26 will then set the backlight level(s) at the determined intensity and the display controller 27 will provide the modified, luminance scaled output frame to the display 29 for display.

The Applicants believe that there remains scope for improvements to methods of and apparatus for processing a frame for provision on a display.

BRIEF DESCRIPTION OF THE DRAWINGS

A number of embodiments of the technology described herein will now be described by way of example only and with reference to the accompanying drawings, in which.

Like reference numerals are used for like features throughout the drawings, where appropriate.

DETAILED DESCRIPTION

Figure 1:
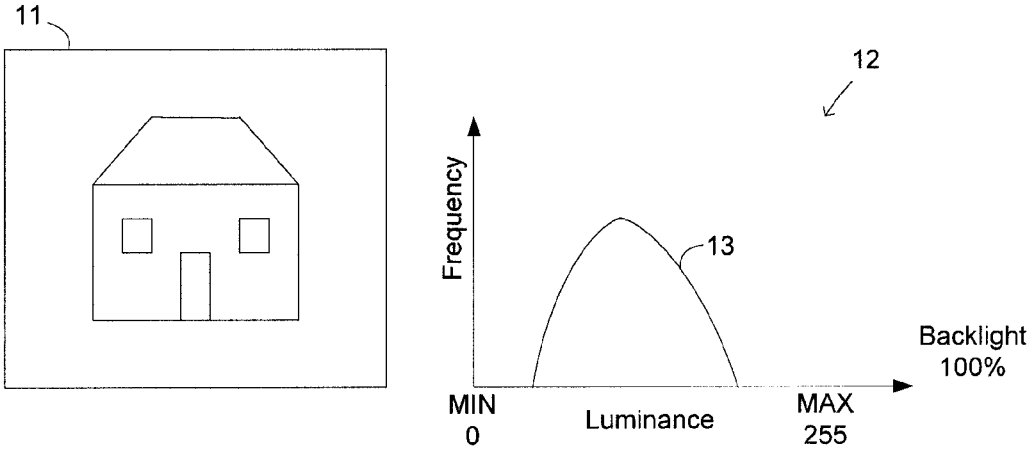
FIGS. 1*a* and 1*b* illustrate schematically the general principles behind brightness compensation operation.
Figure 1:
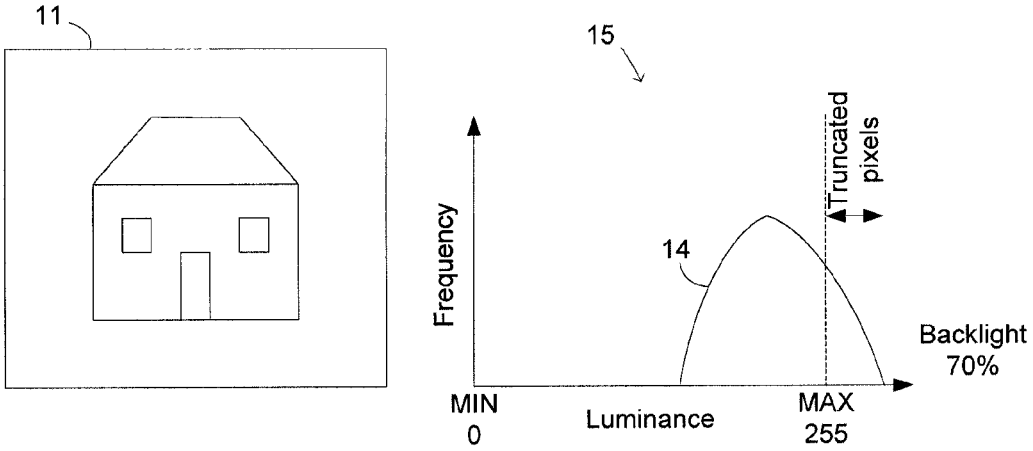

A first embodiment of the technology described herein comprises a method of processing frames for provision on an electronic display, comprising:

generating frames to be displayed;

performing display modifications on the generated frames to provide output frames for display;

the method further comprising:

using information about the display modification to be applied to a generated frame to be displayed to provide an output frame for display, to control an aspect of the generation of a frame to be displayed.

A second embodiment of the technology described herein comprises a system for processing frames for provision on an electronic display, the system comprising:

a frame generation stage for generating frames to be displayed; and a display modification stage for performing display modifications on generated frames to provide output frames for display; and wherein:

the frame generation stage is configured to use information about the display modification to be applied to a generated frame to be displayed to provide an output frame for display, to control an aspect of the generation of a frame to be displayed.

The technology described herein relates to arrangements in which frames to be displayed are generated, for example by being appropriately rendered and stored into a buffer by a frame generator such as a graphics processing system (a graphics processor), a video processing system (video processor), a compositing system (a compositor), etc., but before the generated frame is displayed, the frame is first subjected to display modifications, such as backlight dimming compensation, to provide the output frame that is actually provided to the display for display.

However, in the technology described herein information indicative of the display modifications is also provided (e.g., and in an embodiment, in real-time) to the frame generation process (e.g. to an element or elements of the system relating to and/or involved in the frame generation) and used to control an aspect or aspects of the frame generation.

As will be discussed further below, the Applicants have recognised that knowledge of display modifications, such as backlight dimming compensation, that are being applied to generated frames before they are displayed can also be used advantageously at the frame generation stage, thereby making the overall frame generation and display process more efficient (and thereby, e.g., reducing power consumption and bandwidth). For example, and as will be discussed further below, the knowledge of the display modification that is being applied to the generated frames before they are displayed can, for example, be used to facilitate more efficient compression of the generated frames before they are then displayed (in systems where the generated frames are compressed for storage in the frame buffer before being read therefrom for display).

The frame to be displayed can be generated as desired, and by any appropriate component of the overall data processing system. In an embodiment, the frame to be displayed is a frame generated by a graphics processor, a frame generated by a video processor (video engine), or a frame provided by a composition engine (a compositor).

Thus, the frame generation stage in an embodiment comprises a graphics processor, a video processor (video engine), or a composition engine (a compositor). There may be more than one frame generator if desired, and one or more than one (or all) of the frame generators may be operable in the manner of the technology described herein. The frame generation stage may also include other components, such as a compression stage (compression engine), if desired (and in an embodiment this is the case).

The generated frame to be displayed is in an embodiment stored in an appropriate frame buffer from which it may then be read for the purpose of performing the display modifications on the generated frame to provide the output frame for display.

The display modification operation that is performed on the generated frame(s) to generate the output frames that are provided to the display can be any desired and suitable such modifications, e.g. as are already known and performed in the art.

In an embodiment, the display modification operation comprises a luminance compensation operation (e.g., and in an embodiment, for backlight dimming compensation). The display modification operation may also or instead comprise an operation that is based on (and to adjust for) the (detected) ambient light level.

The display modifications that are performed on the generated frame(s) to generate the output frames that are provided to the display can be performed in any desired and suitable manner, e.g. in a manner known for such modifications.

In embodiments, the display modifications performed on the generated frames to be displayed comprise analysing generated frames (e.g. by use of histograms) to determine data value adjustment parameters, such as, and in an embodiment, a backlight dimming factor and luminance scaling parameters.

Similarly, in embodiments, the display modification performed on a generated frame to be displayed comprises adjusting data values in the frame, such as, and in an embodiment, modifying the frame such that the luminance of each pixel or sub-pixel of the frame is increased (e.g. by applying an appropriate transformation function on the stored data representing the luminance values for the frame).

The display modifications that are performed on the generated frame(s) to generate the output frames that are provided to the display can be implemented and performed in any suitable and desired stage or component of the overall data processing system.

In embodiments, the display modifications (e.g. luminance compensation operation) performed on the generated frame to be displayed is carried out by a luminance and backlight scaling engine. The luminance and backlight scaling engine may be provided as desired, e.g. as a separate stage of the data processing system. In an embodiment it is provided as part of a display controller (thus the system includes a display controller that incorporates a luminance and backlight scaling engine (and the display controller is itself capable of and operates to perform the luminance and backlight scaling process)).

The display modification information that is used to control the frame generation process may be any suitable and desired such information that relates to and/or indicates the display modification process that is to be performed on the generated frame.

In an embodiment, the display modification information is based on or derived from the content of an output frame (that is, the content of a frame resulting from the display modifications). The display modification information may comprise, e.g., and in an embodiment, any suitable set of (e.g. derived) information that can be considered to be representative of how the generated frame will be modified for display.

In an embodiment, the display modification information comprises information that is indicative of and/or that can be used to determine how the data values for the data positions in the generated frame to be displayed will be changed by the display modification operation that will be used to generate the output frame that is provided for display to the display from the generated frame. As will be discussed further below, this then facilitates modifying the values of the data positions within the generated frame at the frame generation stage, which can thereby lead to a number of advantages.

In an embodiment, the display modification information comprises one or more luminance scaling parameters to be used for the generated frame when it is subjected to the display modification operation. The display modification information may thus comprise any one or more of the luminance compensation parameters that are being used for the frame, such as, and in an embodiment, information indicating one or more or all of: the transformation function, the distortion ratio, gain factor, threshold luminance value and/or the saturation value, to be used for the frame.

The display modification information can be provided to the frame generation process by any suitable and desired element or component of the system. In an embodiment it is provided by means of feedback from the element or stage that is performing the display modification operation.

Accordingly, in embodiments the display modification information is provided by a luminance and backlight scaling engine or a display controller that incorporates the luminance and backlight scaling engine.

The display modification information may be provided to any element(s) or stage(s) of the system that is related to or involved in the frame generation. In embodiment, the system comprises a number of frame generators, such as a graphics processing system (a GPU), a video processing system (a video engine), and/or a compositing system (a composition engine), and the display modification information is in an embodiment provided to at least one of, and in an embodiment to each of, the frame generators of the system.

The display modification information may also be provided to and used in other elements of the system that are related to or involved in the frame generator, such as a compression engine or compression stage that operates to compress the generated frames before they are stored in the memory (from which they are then read for the display modification operation).

In general, unless indicated otherwise, it is intended that references to providing the display modification information to the frame generation stage and using the display modification information to control the frame generation process includes all stages and elements of the frame generation process up to the point where the generated frame is stored in the frame buffer from which it is then to be read for the display modification operation.

The information about the display modification to be applied to a generated frame to be displayed can be used to control an aspect or aspects of the generation of the frame to be displayed in any desired and suitable manner, and, correspondingly, can be used to control any desired and suitable aspect or aspects of the generation of the frame to be displayed.

In an embodiment, the display modification information is used to modify data values for data positions within the generated frame. Thus, in an embodiment, the values of data positions in the generated frame are set based on the display modification information (i.e. based on the display modification operation that is to be performed on the generated frame).

The Applicants have recognised in this regard that when performing luminance compensation, for example, some pixels or sub-pixels in the generated frame will have their luminance values re-set to the same, common, e.g., maximum, value by the luminance compensation operation, even if they have different values in the frame as generated (i.e. before the luminance compensation is applied) (i.e. pixels and/or sub-pixels in the frame will have their values truncated above a certain saturation value, such as the maximum pixel or sub-pixel value the system supports).

(For convenience, it will be assumed herein that during luminance compensation operation, for example, the luminance values stored in the frame buffer for the pixels or sub-pixels will be increased (e.g. by applying a suitable transform function), and therefore some pixels or sub-pixels will be saturated to a maximum value, when dimming the backlight. However, it will be understood that the present disclosure is intended to include and encompass all equivalent techniques. For example, there equally could be arrangements that perform luminance compensation operation by decreasing the luminance values stored in the frame buffer for the pixels or sub-pixels. In such an arrangement, the luminance values will be truncated with respect to a lower saturation value, in response to dimming the backlight. This is true for arrangements that use higher luminance values to represent darker shades of a colour, whilst lower luminance values will be used to represent brighter shades of the same colour.)

The Applicants have further recognised in this regard that the, e.g. luminance values, for those data positions that will be saturated in the output frame that is provided for the display can, in effect, accordingly be set to a same, common data value (e.g. the saturated value) (or only a more limited number of data values) at the frame generation stage without affecting the frame that will actually be displayed (since the data values will be saturated in the final output frame in any event), and, moreover, that by setting the data values for the data positions that will be saturated in the final output frame to a common value at the frame generation process, a number of advantages can be achieved.

In particular, this will result in the generated frame containing a larger number of data positions that will each have the same data value (as compared with the data values for the frame if it were generated without performing this operation). Consequently, any compression that is then performed on the generated data frame should be more efficient (because there will be more data positions within the data frame that each have the same value).

Equally, even where compression is not being used, the fact that an increased number of the data positions in the generated frame will have the same value should mean that, for example, transmitting the data values in the system (e.g. to store them in memory) will be more efficient, as, for example, there may be less bus toggling, e.g. for the most significant bits (MSBs), thereby reducing the power consumption of the system.

Also, setting data values in the generated frame to a common data value or values may result in the range of data values required for representing the frame data being reduced, such that the data values for the so-modified frame may then, e.g., be able to be represented using a fewer number of bits for each data value, if desired, thereby again potentially saving bandwidth and memory. For example, it may be possible to eliminate the most or least significant bit (or bits) of the data values. This can then help to, e.g., reduce the amount of data being written and accordingly the bandwidth and power required to communicate the data throughout the system.

Thus, in an embodiment, the display modification information is used to set or modify data values for the data positions in the frame being generated (and that is then to be subject to the display modification operation).

In an embodiment, the information about the display modification operation that is being applied is used to identify data positions within the frame that will be set (e.g. saturated) to a common value as a result of the display modification operation. Those data positions are in an embodiment then set to the same common value (e.g. the saturated, maximum value) in the generated data frame, in an embodiment before it is subjected to any further processing. There may be a single common value that is used for this purpose, or there could be plural common values (e.g. a set of defined common values) that could be used for the data positions. In embodiments, the common, e.g. luminance, value is equal to the saturation value or the threshold, e.g. luminance, value.

This operation may be performed as desired. For example, the frame to be generated could be first generated and stored in memory, and then that frame is analysed to identify the data positions in question and the data values of those data positions then modified accordingly.

In another embodiment, the data positions that will be set to a common value as a result of the display modification operation are identified as the frame to be displayed is being generated and their data values modified (set) accordingly. This may be done by, for example, analysing the data position values of the frame being generated during the (e.g. rasterising and) rendering stage(s) of the frame generation.

The data positions within the frame which will be set to a common value (e.g. saturated) can be identified as desired, for example in dependence upon the nature of the display modification information that is being used. For example, it could be determined which data positions within the frame have values above a threshold value (e.g. above a threshold luminance value) based on the display modification information, and/or the data values of the data positions and the gain factor to be used in the display modification operation could be used to determine those data positions that will be set to a common value after the display modification operation has been carried out.

As discussed above, in an embodiment, the data values in question are luminance values for the data positions, and the luminance values of the identified data positions are set to a common, e.g. saturated, luminance value. However, the data values for the frame could be in another format, e.g. RGB, and the technology described herein can equally be used in that situation as well.

In these arrangements, there may simply be, e.g., a maximum, common value that is considered, such that the data positions that will have that single maximum common value after the display modification operation are identified and have their values set accordingly.

However, it would also be possible, if desired, to use the system of the technology described herein to "quantise" the data values within the frame being generated, such that the frame being generated then includes a reduced, quantised, set of data values. In this case, the range of data values for the frame being generated could, e.g., and in an embodiment, be divided into two or more ranges of data values, with it then being determined based on the display modification information, which range of the data values a given (and each given) data position value will fall within following the display modification operation, with the value for that data position then being set to a single value representative of the range in question.

In this case, the value representative of a given range of data values should be a selected, in an embodiment predetermined, data value for (and in an embodiment within) that range, such as, for example, the highest, lowest, or mid-point value of the range. This will then have the effect of quantising the data values in the frame being generated to a reduced set of available data values, thereby further facilitating, e.g., storage and compression of the frame.

In such arrangements, it would be possible, for example, to quantise all the data values (data positions) within the frame to a reduced set of values in this way, or, alternatively, only a selected set of data values could be quantised in this way. For example a threshold value could be used to select the data values to be quantised, e.g. with only those data values that will be above (or below) a certain, in an embodiment selected, e.g. threshold value (e.g. only those pixel values that will be above the saturation value) being quantised to discrete ranges in this way.

Quantising (reducing) the number of discrete data values for a frame in this way will, in effect, reduce the resolution of the frame.

The Applicants have further recognised that it may be desirable to use the display modification information to indicate certain conditions where one might be happy to reduce the resolution of a frame to be displayed (e.g. in terms of luminance). For example, in some conditions the human eye will find it harder to distinguish between similar luminance values and so will not perceive a dramatic change in image quality if the luminance resolution is reduced.

Thus, in an embodiment it is determined whether to modify a frame to be displayed such that its resolution (e.g. in terms of luminance) is decreased, based on the display modification information.

The, e.g., identification of the relevant data positions and the modification or setting of the data values for those data positions in the frame being generated can be performed in any desired and suitable fashion and can be implemented in any desired and suitable element of the frame generation stage (process). For example, it could be done in the element that is generating the frame to be displayed, such as the GPU, video engine, and/or composition engine in question. It could also be done in another element of the frame generation stage, such as a compression engine that is operating to compress the frames generated by the corresponding frame generator (and in an embodiment, this is what is done). In this case the compression engine (compression stage) could, e.g., analyse the frame as generated by the frame generator to identify those data positions that will be affected by the display modification operation and then modify or set the data values for those data positions accordingly, before then compressing the frame for output.

The frame to be displayed that is being generated may be from a single source (e.g. a GPU or video engine), or it may be a composited frame (e.g. where a frame to be displayed is generated by compositing a number of frames from multiple sources).

In the case where a frame to be displayed is composited from two or more source frames, the two or more source frames can, and in an embodiment will, be modified any one or more of the embodiments described herein to provide two or more modified (e.g. luminance scaled) frames to be composited (i.e. blended), and/or the composited frame can, and in an embodiment will, be modified any one or more of the embodiments described herein to provide a modified composited frame.

The Applicants have further recognised in this regard that for some blending modes such as alpha blending, modifying the source frames based on the display modification information (according to the embodiments described herein) before they are blended together (composited) may introduce additional noise or artefacts in the composited frame.

Thus, in an embodiment the blending mode (operation) to be used for compositing the frames is used to determine whether modification of the frame data based on the display modification information is performed in respect of each of the source frames (before the compositing process), or in (and only in) respect of the composited frame itself (i.e. the frame resulting from the composition process).

For example, if the composition engine is set to operate in an alpha blending mode, modification of the source frames is in an embodiment disabled so that the source frames are first composited before the data for the composited frame is modified based on the display modification information.

As discussed above, using display modification information to influence an aspect or aspects of frame generation is believed to be particularly (but not exclusively) applicable and useful in arrangements that support and use data compression.

Thus, in embodiments, the new frame to be displayed is to be and is stored in memory in a compressed form, and the modification of the frame to be displayed based on the display modification operation is performed before the frame is compressed. Any suitable and desired form of compression can be used in this regard.

The Applicants have further recognised that it would be possible and advantageous to use display modification information to influence the data compression scheme being used to compress generated frames to be displayed. This may be in addition to or alternative to using the display modification information to influence another aspect or aspects of the frame generation.

Thus, in an embodiment, the compression scheme used to compress data representing a frame to be displayed may be and in an embodiment is selected based on the display modification information. In an embodiment, the compression scheme used to compress data representing a frame to be displayed is switched between a lossy and lossless compression mode, based on the display modification information.

The technology described herein, in some embodiments, relates to arrangements where display modifications are performed on a generated frame to be displayed by, for example, analysing frames (e.g. by use of a histogram) to determine an optimum backlight dimming factor and luminance scaling parameters. However, the display modifications performed on the generated frame to be displayed may also include, and be based on, inter alia, analysing the level of ambient light detected at an optical sensor located at the display. (For example, it is often desired to adjust the backlight (and scale the luminance of the pixels or sub-pixels accordingly) for various levels of ambient light detected at the display.)

Thus, in an embodiment, the display modification information comprises information indicating the level (or strength) of ambient light (the ambient light conditions), e.g. detected at an optical sensor located at the display, and the display modification operation comprises modifying a frame to be displayed based on a detected ambient light level or conditions.

Such display modification information may be used in the manner of any of the embodiments described herein. In an embodiment, information indicating the level (or strength) of ambient light detected at an optical sensor located at the display is used to control (select) the compression scheme being used to compress data representing a frame to be displayed.

The operation in the manner of the technology described herein and the, e.g., modification of the generated frames, can, e.g., be performed for a frame as a whole (and in one embodiment, this is what is done). This may be appropriate where, for example, the backlight is controlled across the whole display screen with a single dimming factor that is applied across the entire frame.

However, it would also be possible for the arrangements of the technology described herein to be applied to selected frame regions only, and, e.g., on a frame region-by-frame region basis. This may be particularly appropriate where, for example, the display supports local backlight dimming, such that different regions of the display can be subject to different levels of backlight dimming.

Thus, in an embodiment, the operation in the manner of the technology described herein is applied to respective regions of the frames (which regions form part but not all of the frames). In this case, the operation could be performed for only some but not all of the regions of the frame, but in an embodiment is applied to each respective region of a frame.

Also, as will be appreciated by those skilled in the art, in these arrangements different frame modification information, frame data value modifications, etc., may be (and typically will be) applied to different regions within a frame, e.g. depending upon the display modification operation that is being performed for the region in question. For example, multiple data value (e.g. luminance value) histograms may be generated per frame, e.g. one for each region that the frame is divided into. Each separate region will then be subjected to its own display modification operation.

In these arrangements, the regions that the frames are divided into for this purpose can be any suitable and desired such regions, e.g. corresponding to the regions for which separate (independent) backlight control is possible. For example, the regions may correspond to one or more processing tiles that make up the frames to be displayed, depending on the corresponding backlight area to which the set of processing tiles relates.

The control of the aspect of the generation of a frame to be displayed using display modification operation information can be based on display modification information derived from and/or to be used for any desired generated frame or frames to be displayed. Thus, the display modification operation and corresponding display modification information to be applied to and for a frame to be displayed can be based on and derived from an analysis of any desired frame or frames to be displayed.

In one embodiment, the display modification information that is used is derived from or for the frame whose generation it is to be used to control. In this case, information indicative of the display modification to be applied to the current frame at the display modification stage will be used at the frame generation stage to control an aspect or aspects of the generation of that same current frame. In this case, the frame to be generated could be generated and the display modification information derived, with the generated frame then having its values modified accordingly, before, e.g., being compressed for transmission or storage.

In an embodiment, the display modification operation and corresponding display modification information used to control the generation of a frame to be displayed is based on an analysis of and display modification information derived for a different frame or frames, e.g., and in an embodiment, a preceding frame or frames, in the sequence of frames being displayed. Thus, e.g., information about the display modification operation applied to a preceding frame or frames to provide a preceding output frame or frames, is used to control an aspect or aspects of the generation of a subsequent frame or frames to be displayed Thus, in embodiments the technology described herein comprises providing display modification information derived from or for a preceding frame or frames (i.e. an output frame or output frames) to the frame generation process or stage, and then using that display modification information to control an aspect or aspects of the generation of a subsequent frame or frames to be displayed. Thus display modification information for the current frame or current output frame will be used to control (and e.g. modify) the generation of a subsequent frame or frames at the frame generation stage.

In this regard, if desired the operation to modify the frames being generated in the manner of the technology described herein can be disabled periodically in a sequence of frames being displayed to, e.g., allow new display modification information (e.g. parameters) to be derived from unmodified generated frames, for use then with and for subsequent frames to be generated.

Furthermore, the Applicants have recognised that frames will often be substantially unchanged (and therefore the display modifications performed on the frames will be substantially unchanged) from frame-to-frame, and that the backlight may not be able to be updated (altered) rapidly, e.g., every time a new frame is generated and processed for display.

Therefore, the operation to perform display modifications on generated frames to be displayed can be set such that the adjustment of the data values in a frame (e.g. during luminance compensation operation) is the same for a sequence of frames being displayed. Thus, the display modification information (e.g., a set of data value adjustment parameters such as, in an embodiment, luminance scaling parameters) that has been determined for a generated frame can be used to perform display modifications (e.g. to adjust the data values) for each frame of a sequence of subsequent frames.

It will be appreciated, therefore, that in such arrangements, it is not necessary for the display modification operation to comprise analysing each generated frame of the sequence of subsequent frames (e.g. by use of histograms) to determine new display modification information (parameters) for the frames.

Thus, the operation to analyse generated frames (e.g. by use of histograms) to determine display modification information (parameters) can, in some circumstances, be disabled in a sequence of frames.

In one embodiment, the display modification information for a number of successive frames is analysed, and where the display modification information for a given, in an embodiment selected, in an embodiment predetermined, number of successive frames have been determined to be substantially unchanged (e.g. according to some predefined criteria), then the operation to analyse generated frames (e.g. by use of histograms) to determine display modification information (parameters) can be disabled for subsequent frames.

Alternatively, the content of a number of successive frames (e.g. in terms of luminance) is analysed, and where the content of a given, in an embodiment selected, in an embodiment predetermined, number of successive frames have been determined to be substantially unchanged (e.g., according to some predefined criteria), then the operation to analyse generated frames (e.g. by use of histograms) to determine display modification information (parameters) for the frames can be disabled for subsequent frames.

In other embodiments, the operation to analyse generated frames (e.g. by use of histograms) to determine display modification information (parameters) for the frames can be repeated periodically. In this way, the display modification information to be used to control an aspect or aspects of the generation of subsequent frames to be displayed will be updated periodically. The operation to analyse generated frames (e.g. by use of histograms) to determine display modification information (parameters) can be set to repeat after a given, in an embodiment selected, in an embodiment predetermined, number of frames have been processed and displayed, for example, or may be set at the frequency at which the intensity of the backlight can be altered.

Analysing a fewer number of generated frames to determine new display modification information (parameters) is advantageous in that it will reduce the amount of processing power consumed by the system (compared to the amount of power that would be consumed if the system were set to analyse each generated frame to be displayed).

It will be appreciated that the operation to perform display modifications on generated frames, and thus the operation to control an aspect or aspects of generation of a frame based on information about the display modification to be applied to the frame, may be performed for selected frames only (rather than for all of the frames to be generated and processed for display).

In some embodiments, the operation to perform display modifications, and the operation to control an aspect or aspects of frame generation based on display modification information can be disabled (and correspondingly re-enabled) periodically.

In embodiments, the operation to perform display modifications, and the operation to control an aspect or aspects of frame generation based on display modification information can be disabled when a generated frame meets a certain criteria. For example, if it is determined by analysis (e.g. by use of a histogram) that a generated frame is particularly bright (such that there is little opportunity for luminance scaling, for example), then the operation to perform display modifications on generated frames to provide output frames for display, and thus the operation to use information about the display modification to be applied to generated frames to be displayed to control an aspect of the generation of the frames to be displayed, is in an embodiment disabled for a subsequent frame or frames.

The operation may be disabled for a given, in an embodiment selected, in an embodiment predetermined, number of subsequent frames, or may be disabled indefinitely. In the latter case, if desired the system could periodically analyse generated frames (e.g. by use of histograms) to determine whether or not to re-enable display modification operation, and thus the operation to control an aspect or aspects of frame generation based on display modification information.

Once the generated frame has been appropriately, e.g., modified, in accordance with the operation of the technology described herein it is in an embodiment then stored in memory from where it may then be read and processed for display, for example by subjecting it to the relevant display modification operation at the display stage. The generated frame may also, as discussed above, be compressed before writing it to memory, if desired.

This process may then be repeated for the next frame to be displayed and so on. (As will be appreciated by those skilled in the art, the technology described herein would typically be, and in an embodiment is, implemented for a sequence of frames to be displayed, and in an embodiment for each frame in a sequence of frames to be displayed, subject possibly to disabling the operation periodically so as to derive new display modification parameters.)

The technology described herein can be implemented in any desired and suitable data processing system that is operable to generate frames for display on an electronic display. The system in an embodiment includes a display, which is in an embodiment in the form of an LCD or an OLED display.

In an embodiment the technology described herein is implemented in a data processing system that is a system for displaying windows, e.g. for a graphical user interface, on a display, and in an embodiment a compositing window system.

The data processing system that the technology described herein is implemented in can contain any desired and appropriate and suitable elements and components. Thus it may, and in an embodiment does, contain one or more of, and in an embodiment all of: a CPU, a GPU, a video processor, a display controller, a display, and appropriate memory for storing the various frames and other data that is required.

The generated frame(s) to be displayed and the output frame for the display (and any other source surface (frames)) can be stored in any suitable and desired manner in memory. They are in an embodiment stored in appropriate buffers. For example, the output frame is in an embodiment stored in an output frame buffer.

The output frame buffer may be an on-chip buffer or it may be an external buffer (and, indeed, may be more likely to be an external buffer (memory), as will be discussed below). Similarly, the output frame buffer may be dedicated memory for this purpose or it may be part of a memory that is used for other data as well. In some embodiments, the output frame buffer is a frame buffer for the graphics processing system that is generating the frame and/or for the display that the frames are to be displayed on.

Similarly, the buffers that the generated frames are first written to when they are generated (rendered) may comprise any suitable such buffers and may be configured in any suitable and desired manner in memory. For example, they may be an on-chip buffer or buffers or may be an external buffer or buffers. Similarly, they may be dedicated memory for this purpose or may be part of a memory that is used for other data as well. The input frame buffers can be, e.g., in any format that an application requires, and may, e.g., be stored in system memory (e.g. in a unified memory architecture), or in graphics memory (e.g. in a non-unified memory architecture).

The technology described herein can be implemented in any suitable system, such as a suitably configured micro-processor based system. In some embodiments, the technology described herein is implemented in computer and/or micro-processor based system.

The various functions of the technology described herein can be carried out in any desired and suitable manner. For example, the functions of the technology described herein can be implemented in hardware or software, as desired. Thus, for example, the various functional elements and "means" of the technology described herein may comprise a suitable processor or processors, controller or controllers, functional units, circuitry, processing logic, microprocessor arrangements, etc., that are operable to perform the various functions, etc., such as appropriately dedicated hardware elements (processing circuitry) and/or programmable hardware elements (processing circuitry) that can be programmed to operate in the desired manner. Similarly, the display that the windows are to be displayed on can be any suitable such display, such as a display screen of an electronic device, a monitor for a computer, etc.

It should also be noted here that, as will be appreciated by those skilled in the art, the various functions, etc., of the technology described herein may be duplicated and/or carried out in parallel on a given processor. Equally, the various processing stages may share processing circuitry, etc., if desired.

The technology described herein is in an embodiment implemented in a portable device, such as, and in an embodiment, a mobile phone or tablet.

The technology described herein is applicable to any suitable form or configuration of graphics processor and renderer, such as processors having a "pipelined" rendering arrangement (in which case the renderer will be in the form of a rendering pipeline). It is particularly applicable to tile-based graphics processors, graphics processing systems, composition engines and compositing display controllers.

It will also be appreciated by those skilled in the art that all of the described embodiments of the technology described herein can include, as appropriate, any one or more or all of the optional features described herein.

The methods in accordance with the technology described herein may be implemented at least partially using software e.g. computer programs. It will thus be seen that when viewed from further embodiments the technology described herein provides computer software specifically adapted to carry out the methods herein described when installed on a data processor, a computer program element comprising computer software code portions for performing the methods herein described when the program element is run on a data processor, and a computer program comprising code adapted to perform all the steps of a method or of the methods herein described when the program is run on a data processing system. The data processing system may be a microprocessor, a programmable FPGA (Field Programmable Gate Array), etc.

The technology described herein also extends to a computer software carrier comprising such software which when used to operate a graphics processor, renderer or other system comprising a data processor causes in conjunction with said data processor said processor, renderer or system to carry out the steps of the methods of the technology described herein. Such a computer software carrier could be a physical storage medium such as a ROM chip, CD ROM, RAM, flash memory, or disk, or could be a signal such as an electronic signal over wires, an optical signal or a radio signal such as to a satellite or the like.

It will further be appreciated that not all steps of the methods of the technology described herein need be carried out by computer software and thus from a further broad embodiment the technology described herein provides computer software and such software installed on a computer software carrier for carrying out at least one of the steps of the methods set out herein.

The technology described herein may accordingly suitably be embodied as a computer program product for use with a computer system. Such an implementation may comprise a series of computer readable instructions fixed on a tangible, non-transitory medium, such as a computer readable medium, for example, diskette, CD ROM, ROM, RAM, flash memory, or hard disk. It could also comprise a series of computer readable instructions transmittable to a computer system, via a modem or other interface device, over either a tangible medium, including but not limited to optical or analogue communications lines, or intangibly using wireless techniques, including but not limited to microwave, infrared or other transmission techniques. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical, or transmitted using any communications technology, present or future, including but not limited to optical, infrared, or microwave. It is contemplated that such a computer program product may be distributed as a removable medium with accompanying printed or electronic documentation, for example, shrink wrapped software, pre loaded with a computer system, for example, on a system ROM or fixed disk, or distributed from a server or electronic bulletin board over a network, for example, the Internet or World Wide Web.

A number of embodiments of the technology described herein will now be described.

As discussed above, the technology described herein relates to systems in which display modification information for frames being displayed is used to influence an aspect or aspects of the frame generation when providing frames to be displayed.

Figure 2:
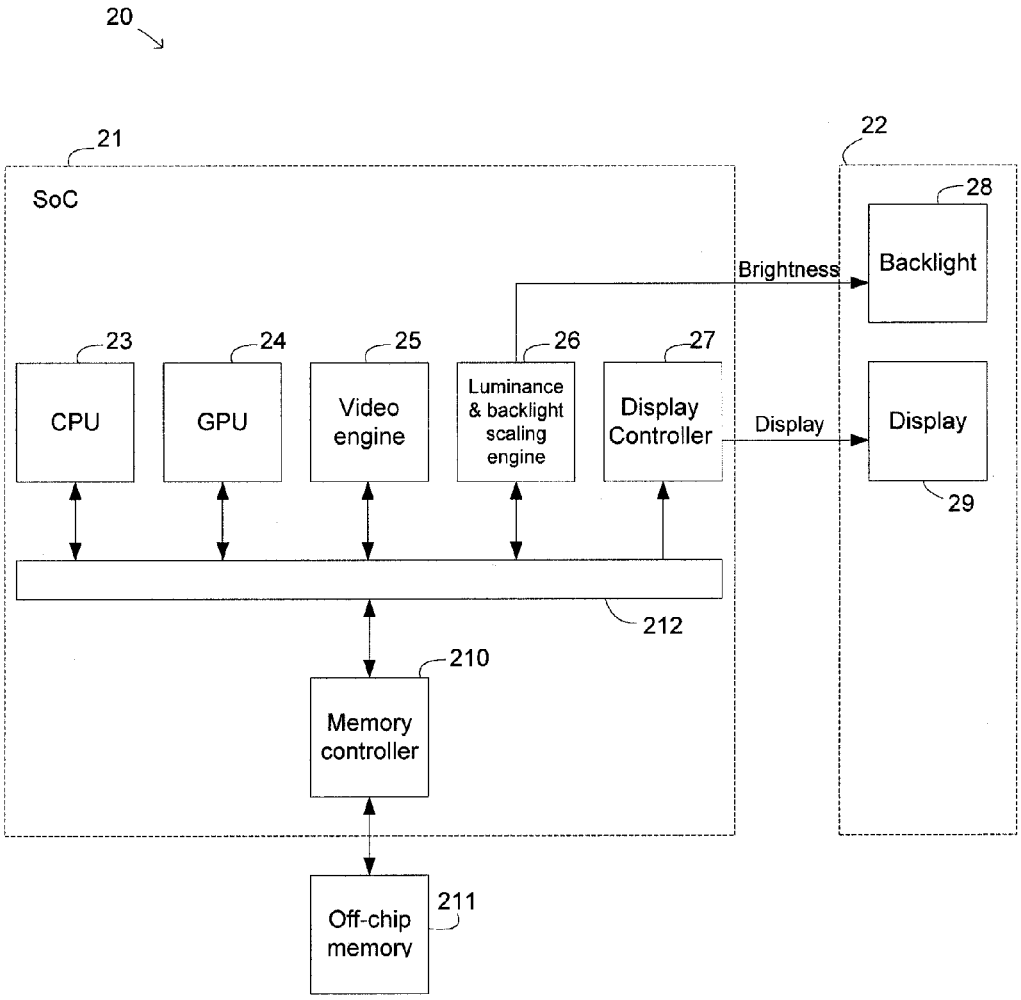
FIG. 2 illustrates schematically an exemplary data processing system that performs dynamic luminance and backlight scaling operation.
Figure 3:
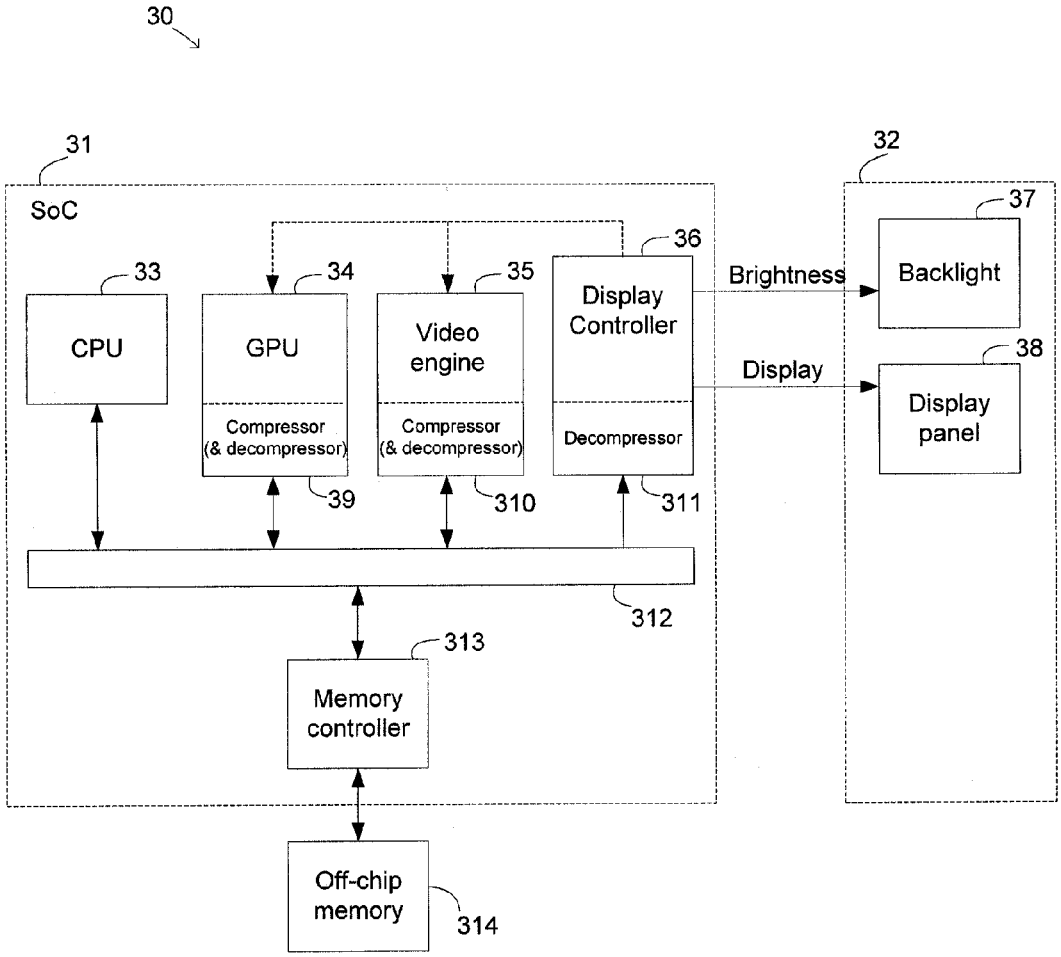
FIG. 3 shows schematically an exemplary data processing system that can operate in accordance with the described embodiments of the technology described herein.

FIG. 3 shows schematically an exemplary data processing system 30 that can perform the basic operation of the technology described herein. This is similar to the system described above with reference to FIG. 2, but with a number of important differences.

As shown in FIG. 3, the data processing system 30 may comprise a system on-chip (SoC) 31 which includes a CPU 33, a GPU 34, a video processing engine (video engine) 35, a display controller 36 and a memory controller 313, all having access to off-chip memory 314. In this embodiment, the display controller 36 is a display controller that is itself capable of and operates to perform luminance and backlight scaling operations. (Of course, other arrangements, e.g. in which a separate luminance and backlight scaling engine performs luminance and backlight scaling operations separately to a display controller are equally possible.)

Separate to the SoC and off-chip memory is the display 32 itself, which includes a backlight 37 and a display panel 38, e.g. an LCD panel.

In the embodiment shown in FIG. 3, the GPU 34 and video engine 35 include compressors (compression engines) (and corresponding de-compressors) 39 and 310, respectively, for encoding (compressing) data (e.g. a frame) to be stored in memory in a compressed form. Accordingly, the display controller 36 includes a de-compressor 311 for decompressing data (e.g. a frame to be displayed).

(Compression and de-compression of the generated frames can be provided in other ways, if desired. For example, instead of the GPU 34 and video engine 35, etc. including compression engines, a separate compression and de-compression engine that receives frames from the frame generators and compresses them before writing them to memory and that correspondingly reads frames from memory and decompresses them before providing them to the, e.g., display controller, could be provided in the system.)

In accordance with the present embodiments, a frame to be displayed is generated as desired by, for example, being appropriately rendered by the GPU 34 or video engine 35. The generated frame is then stored (e.g. in a compressed form) in a frame buffer within the off chip memory 314.

To be displayed, the generated frame is first fetched from the off-chip memory 314 by the display controller 36 and is, if appropriate, decompressed by the de-compressor 311 of the display controller 36. The display controller 36 will then perform display modifications on the (e.g. de-compressed) frame to provide an output frame for display. According to embodiments of the technology described herein, the display modifications performed on the generated frame to be displayed include analysing the generated frames (e.g. by means of a histogram) to determine an optimum backlight dimming factor and luminance compensation parameters for the frames.

The luminance compensation parameters are then used to modify the frames to be displayed to provide luminance compensated output frames for display. The output frame for display is then used to derive drive voltages for the display panel 38 (so as to display the correct colour), whilst the determined backlight dimming factor is used to set the backlight 37 at the appropriate brightness level.

After completing display modifications, the display controller 36 provides (e.g. in real-time) display modification information (such as the determined luminance compensation parameters) to the GPU 33 and video engine 34. This "feedback" of display modification information to the frame generators from the display controller 36 is illustrated by the dotted arrows in FIG. 3.

At the GPU 34 or video engine 35, the display modification information is used to influence an aspect or aspects of the frame generation process. For example, the GPU 34 or video engine 35 is configured to modify frame buffer data that is generated for a frame to be displayed (to provide a new frame to be displayed), based on the display modification information for the output frame.

This will then be repeated for subsequent frames to be displayed (thus a new frame to be displayed will then be fetched by the display controller 36 and it will perform display modifications on the new frame to be displayed to provide a new output frame for display, and so on).

The embodiments of the technology described herein can be implemented in any desired form of data processing system that provides frames for display. Thus they could, for example, be used in a system in which a centralised compressor and/or de-compressor is used (and acts as an intermediate between the components of the SoC 31 and the off-chip memory 314). This is in contrast to the arrangement in which each of the frame generators includes a separate compressor and/or de-compressor (39, 310 and 311). Of course, arrangements that do not support compression and/or de-compression are equally possible.

Additionally, it will be understood that although the arrangement of FIG. 3 shows only two frame generators (the GPU 34 and video engine 35), the data processing system of the technology described herein could include any number (and types) of frame generators, as appropriate.

Further, it will be understood that the display modification information could (and in an embodiment will) be provided to (and used in) any stage of frame generation process.

Figure 4:
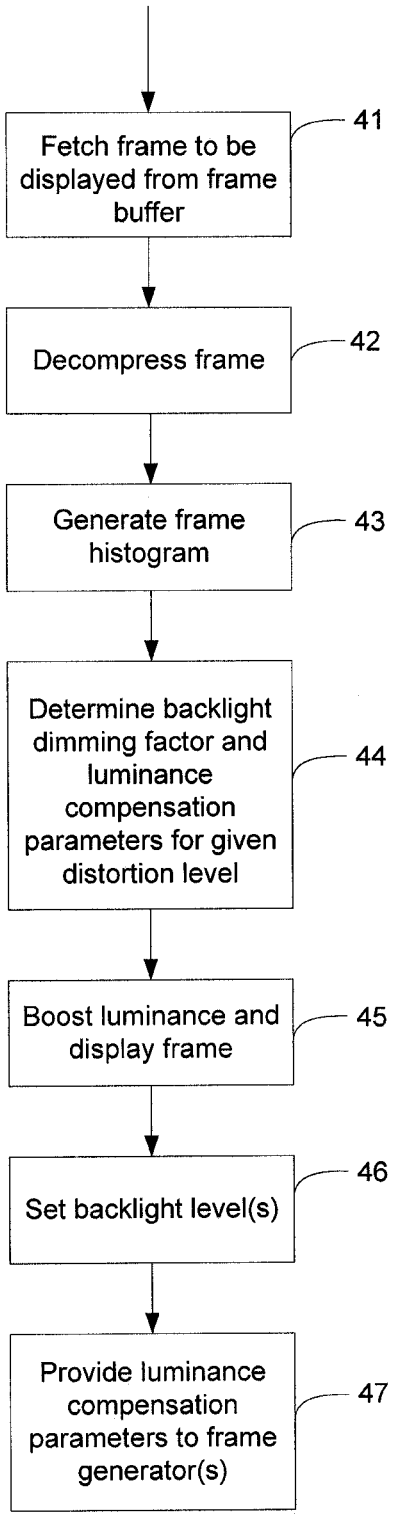
FIG. 4 is a flowchart illustrating the operation of the display controller according to embodiments of the technology described herein.

FIG. 4 shows in more detail the operation of the display controller of FIG. 3 when set to operate in a manner according to the embodiments of the technology described herein. It is assumed here that a new frame to be displayed is required, e.g. to refresh the display. It is also assumed that the display controller is set to perform luminance compensation modifications as described above.

As shown in FIG. 4, operation of the display controller begins at step 41 when the display controller operates to fetch (from e.g. a frame buffer) a previously generated frame (of data) to be displayed.

As mentioned above, the frame to be displayed may be stored in the frame buffer in a compressed form. In such cases, the (compressed) frame to be displayed is de-compressed by the display controller (a de-compressor within the display controller, in particular) at step 42.

In step 43, the display controller operates to generate a histogram (or at least an array of data representing a histogram) for the frame to be displayed, so as to allow the density distribution of the display pixels or sub-pixels across their possible luminance values to be determined.

The histogram (data) of the frame is then analysed at step 44 to determine an optimum backlight dimming factor and optimum luminance compensation parameters for a given distortion ratio (which may be set by a user). For example, histogram analysis will allow the required threshold luminance value (and thus gain factor) for an acceptable distortion ratio to be determined for the frame to be displayed.

Following this determination, the display controller will modify the frame buffer data accordingly so as to generate an output frame that is outputted for display (step 45). This is achieved by, for example, boosting the luminance values of the frame to provide a luminance compensated output frame that is then outputted to the display for display.

At step 46, the determined optimum backlight dimming factor is used to set the backlight at the appropriate intensity level.

At step 47, display modification information (particularly the determined optimum luminance compensation parameters) is then provided (e.g. in real-time) to the frame generator(s) (e.g. a GPU or video engine) to be used for influencing subsequent frame generation and/or manipulation, as described above.

Steps 41, 42 and 45 are repeated every time a new frame to be displayed is required, e.g. to refresh the display, for as long as the system is set to perform the luminance compensation operation. Steps 43, 44, 46 and 47 can be performed as desired. For example, steps 43, 44, 46 and 47 could be set to repeat every time a new frame to be displayed is required, or after a predetermined number of frames have been processed and displayed, or as often as the backlight can be updated.

Figure 5:
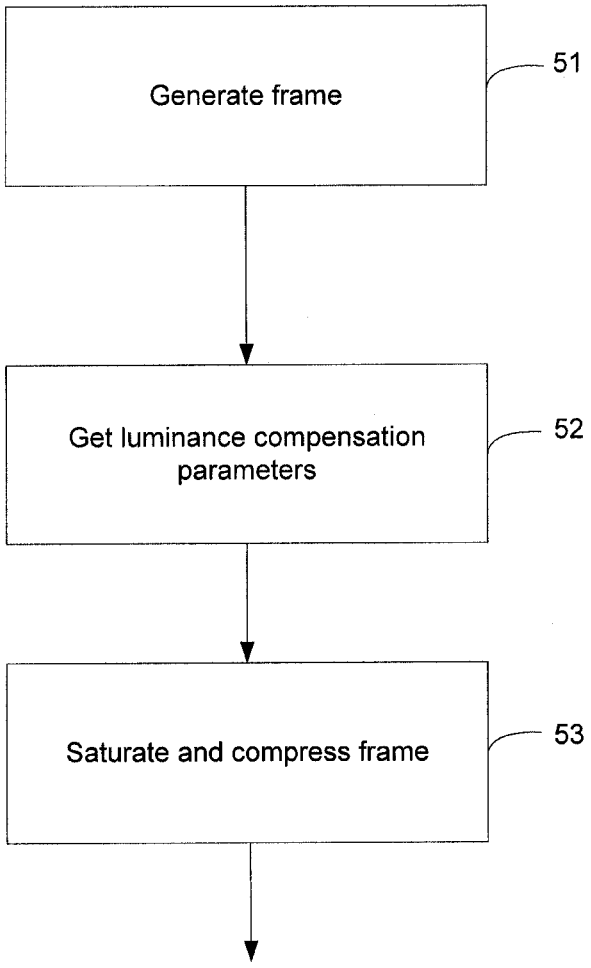
FIGS. 5 and 6 are flowcharts illustrating the operation of the frame generators (the video engine and GPU) in embodiments of the technology described herein.
Figure 6:
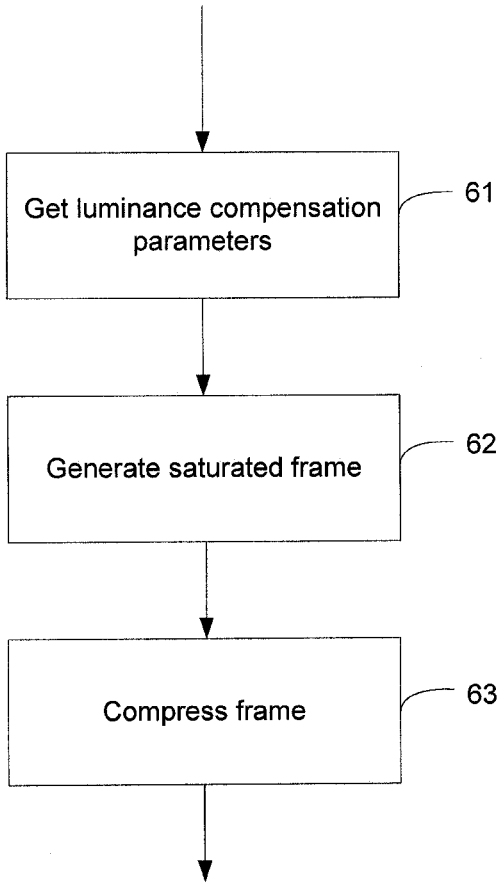

FIGS. 5 and 6 show in more detail the operation of the frame generators (the video engine and GPU) of FIG. 3 when set to provide a new frame to be displayed based on the display modification information provided by the display controller of FIG. 3. It is again assumed that the display controller is set to perform luminance compensation modifications as described above.

As shown in FIG. 5, the frame generator(s) will firstly generate a new frame (of data) to be displayed (step 51). The new frame to be displayed is generated as desired by, for example, being appropriately rendered and stored (e.g. in a compressed form) in a frame buffer (within e.g. an off-chip memory).

At step 52, the frame generator(s) will get the display modification information, particularly the determined optimum luminance compensation parameters (as described above with reference to FIG. 4), for the frame, e.g. from the display controller.

At step 53, the frame generator(s) will modify the frame to be displayed based on the display modification information. In this particular example, the frame generator(s) will operate to identify pixels or sub-pixels of the new frame to be displayed that are likely to be saturated by the display modifications and then "saturate" those pixels or sub-pixels for the new frame to be displayed (by setting the identified pixels or sub-pixels to a common, e.g. maximum, luminance value).

The "saturated" frame can then be compressed as desired.

The saturated (and compressed) frame will then be fetched by the display controller for display modifications prior to display.

FIG. 6 shows an alternative arrangement to that of FIG. 5, where the frame to be displayed is "saturated" as the new frame to be displayed is being generated.

At step 61, the frame generator(s) will first receive the determined optimum luminance compensation parameters (as described above with reference to FIG. 4) for the frame from the display controller.

At step 62, the frame generator(s) will generate and store in a frame buffer a "saturated" frame (of data) to be displayed, based on the luminance compensation parameters provided thereto. This may be done during the (e.g. rasterising and) rendering stage(s) of frame generation by, for example, analysing the sampling position values taken for the pixels or sub-pixels of the new frame to be displayed so as to identify pixels or sub-pixels of the new frame to be displayed that will be saturated by the display modification operation. The frame generator(s) will then store in memory a "saturated" luminance value for those identified pixels or sub-pixels of the new frame to be displayed.

The saturated frame buffer data could then be compressed and stored in a frame buffer at step 63.

Again, the saturated and compressed frame will then be fetched by the display controller for display modifications prior to display.

Figure 7:
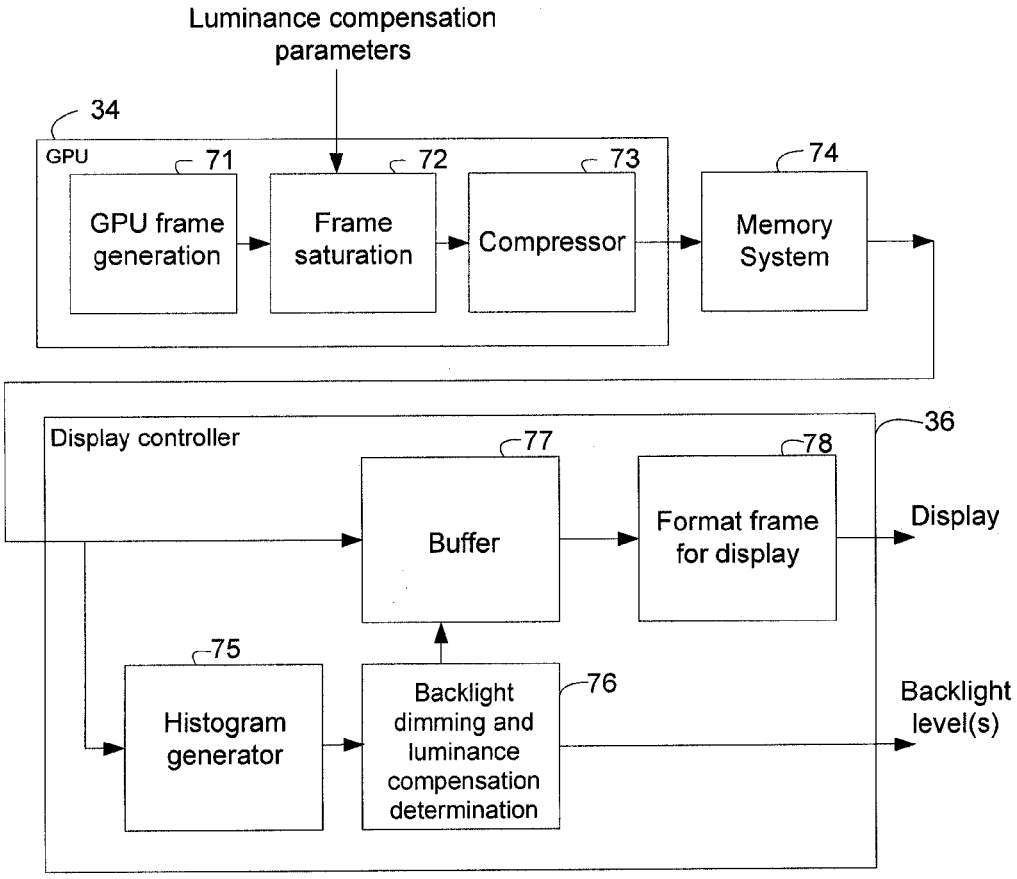
FIG. 7 is a block diagram showing schematically the data and control flows etc., between a GPU and a display controller in embodiments of the technology described herein.

FIG. 7 shows schematically the data flow between a GPU 34 and a display controller 36 that can operate in the manner of the present embodiments.

The GPU 34 generates a (new) frame to be displayed in a frame generation block 71 as desired. The generated frame is then "saturated" in a frame saturation block 72 of the GPU 34, based on luminance compensation parameters provided to the frame saturation block 72. Although not shown, the luminance compensation parameters may be provided by the display controller 36.

The saturated frame is then compressed by a compressor 73 of the GPU 34 before being stored in a memory system 74 via e.g. a bus interface (not shown).

In order to be displayed, the compressed frame is sent to (or fetched by) the display controller 36, where it is then de-compressed. In the display controller 36, a region of the frame (that is to be subjected to luminance compensation operation) is stored in buffer 77, whilst a histogram generator 75 generates a histogram (or at least an array of data representing a histogram) for the frame region. The histogram for the frame region is then analysed for modification of the display. In particular, an optimum backlight dimming factor and luminance compensation parameters are determined at block 76.

Following this determination, the luminance compensation parameters are used to modify the frame region stored in the buffer 77 so as to provide an output frame (i.e. a luminance compensated frame) for display. As will be appreciated by those skilled in the art, the output frame may comprise modified frame regions and/or frame regions that have not been subjected to luminance compensation operation. The determined backlight dimming factor is then used to set the backlight (not shown) to the appropriate level of brightness.

The (luminance compensated) output frame, meanwhile, is then formatted at block 78 before being outputted to the display (e.g. via an interface) for display.

Although not shown, it will be appreciated that in most cases, display modification information for the output frame will be provided back to the GPU 34 (e.g. in real-time) so as to influence an aspect or aspects of subsequent frame generation and/or manipulation.

Figure 8:
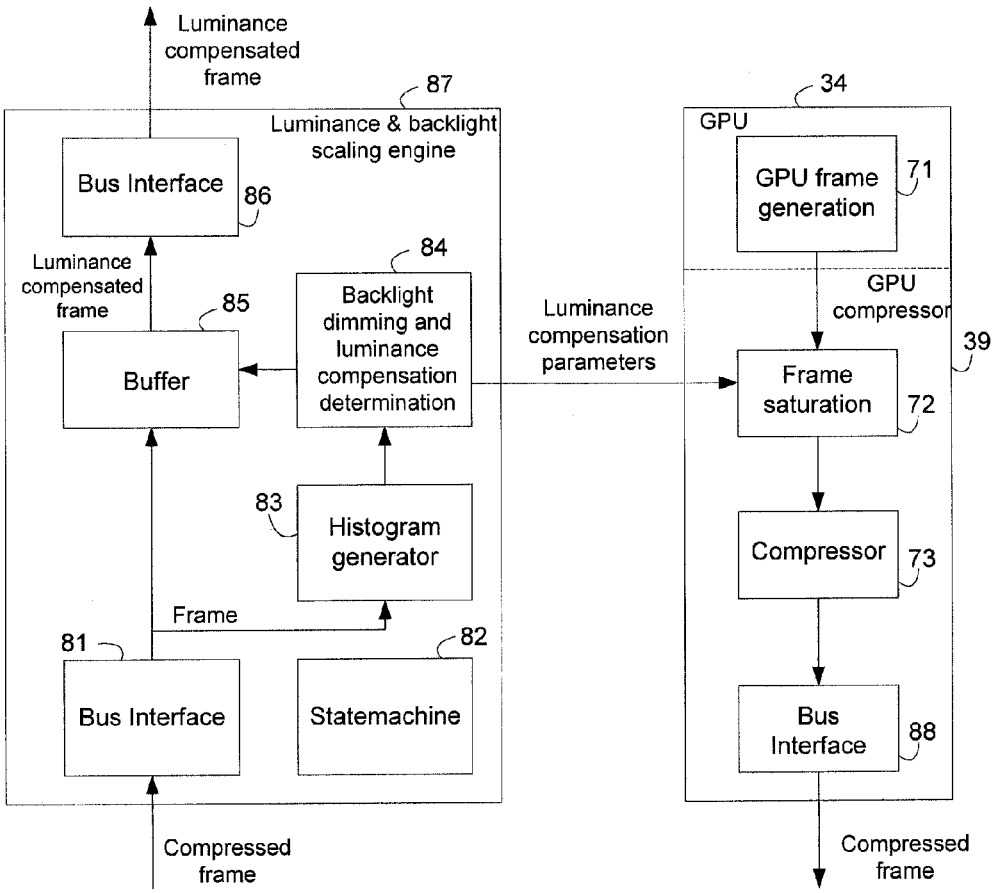
FIG. 8 is a block diagram showing schematically the data and control flows, etc. in a GPU and a luminance and backlight scaling engine in embodiments of the technology described herein.

FIG. 8 shows a similar arrangement to that of FIG. 7, except that in this example, the data flow between a GPU 34 and a luminance and backlight scaling engine 87 that performs display modification operations is shown.

As shown in FIG. 8, the luminance and backlight scaling engine 87, which is under control of a state machine 82, includes a bus interface 81 that is operable to fetch from the frame buffer memory (not shown) a compressed frame to be displayed, and will decompress the data as appropriate (e.g. by use of a decompression engine that is not shown).

Similarly to the display controller of FIG. 7, the luminance and backlight scaling engine 87 stores a region of the (de-compressed) frame (that is to be subjected to luminance compensation operation) in buffer 85 whilst a histogram generator 83 generates a histogram (or at least an array of data representing a histogram) for the frame region. The histogram for the frame region is then analysed at block 84 to determine an optimum backlight dimming factor and luminance compensation parameters for the frame region.

The luminance compensation parameters are used to modify the frame region stored in the buffer 85 so as to provide an output frame (i.e. a luminance compensated frame) for display and the determined backlight dimming factor is used to set the brightness of the backlight (not shown). Again, it will be appreciated by those skilled in the art that the output frame may comprise modified frame regions and/or frame regions that have not been subjected to luminance compensation operation.

In order to influence an aspect or aspects of the frame generation and/or manipulation when providing frames to be displayed, the luminance and backlight scaling engine 87 provides the luminance compensation parameters to the GPU 34, particularly the frame saturation block 72 located in the compressor 39 of the GPU 34.

Following generation of a new frame to be displayed in the GPU frame generation block 71, the frame buffer saturation block 72 modifies the new frame data so as to generate a saturated frame based on the luminance compensation parameters provided to the frame saturation block 72. The saturated frame is then compressed by a compressor 73 of the GPU 34 before being stored in a frame buffer (not shown) via another bus interface 88.

Whilst the arrangements of FIGS. 7 and 8 show that the display controller 36 or luminance and backlight scaling engine 87 generates and analyses a histogram for the current frame region to be displayed (e.g. to determine an optimum backlight dimming factor and luminance compensation parameters to be used for the frame region), it will be appreciated that the display controller 36 or luminance and backlight scaling engine 87 could instead use the luminance compensation parameters that were determined for the corresponding frame region of a previous frame. In this case, the display modification information, e.g., the luminance compensation parameters, for the corresponding frame region of a previous frame are used to modify the frame region stored in the buffer 77 or 85 so as to provide an output frame, i.e. a luminance compensated frame, for display.

Furthermore, although FIGS. 7 and 8 show the data and control flows, etc. in a GPU 34 and a luminance and backlight scaling engine 87 or display controller 36, it will be understood that the GPU 34 may be replaced by any other type of frame generator, such as a video engine.

Moreover, although the above embodiments have been described with particular reference to the use of a compressor, as will be appreciated, the use of a compressor is not essential to the present embodiments and is not intended to limit the scope of the application. For example, the Applicants have recognised that there may still be an advantage to saturating a newly generated frame based on the display modification information (e.g. luminance compensation level(s)) for the current frame (or frame regions) being displayed (without compression).

Figure 9:
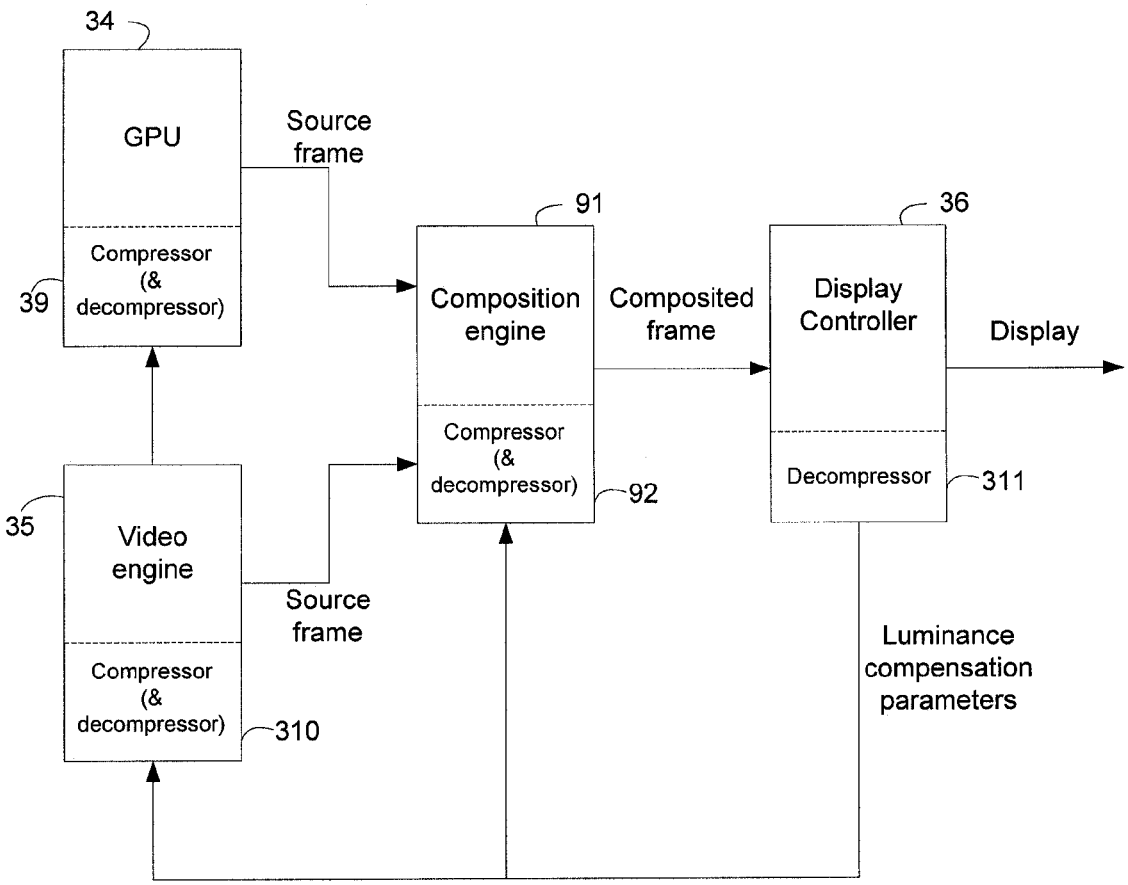
FIG. 9 shows schematically an exemplary data processing system that can operate in accordance with the described embodiments of the technology described herein.

FIG. 9 shows schematically a data processing system which includes the GPU 34 and video engine 35 of FIG. 3, and a composition engine 91 that generates and provides composited frames to a display controller 36 for display. The display controller 36 corresponds to that of FIG. 3 and is as described with reference to FIG. 4.

The composition engine 91 operates to read source frames from the GPU 34 and video engine 35 and generate a composited frame to be displayed. This can be done as desired, for example by blending or otherwise combining the source frames. The process can also involve applying transformations (skew, rotation, scaling, etc.) to the source frames, if desired.

As shown in FIG. 9, the display controller 36 operates to provide to the GPU 34, video engine 35 and composition engine 91, the display modification information, particularly the luminance compensation parameters. The luminance compensation parameters are then used to influence an aspect of frame generation and/or manipulation, in accordance with the embodiments described above.

For example, in one arrangement the source frames are "saturated" at the GPU 34 and video engine 35 (based on the luminance compensation parameters) before being composited in the composition engine 91.

In another example, operation of the GPU 34 and video engine 35 is altered such that saturation of the source frames in the GPU 34 and video engine 35 is disabled, and operation of the composition engine 91 is altered such that the source frames are first composited in the composition engine 91 before the composited frame itself is saturated based on the display modification information (i.e. saturation of the composited frame is enabled).

The decision as to whether saturation is performed on the source frames before compositing or on the composited frame (i.e. after compositing) in the composition engine 91 could be based on the blending mode used by the composition engine 91, for example.

It can be seen from the above that the technology described herein, in its embodiments at least, provides a way of performing more intelligent and/or complex operations when processing frames for provision on an electronic display, when allowing the power consumed by the backlight of the display to be reduced.

This is achieved, in the embodiments of the technology described herein at least, by when display modification operations (such as luminance and backlight scaling) are being performed on a frame to be displayed to provide an output frame for display, providing display modification information for the output frame to an element or elements of hardware relating to frame generation so as to influence an aspect or aspects of the generation and/or manipulation of the frames to be displayed.

Further, the technology described herein allows the amount of data transferred throughout the data processing system to be reduced by appropriately modifying the frames to be displayed (whilst at the frame generation and/or manipulation stage), based on the display modification information.

The foregoing detailed description has been presented for the purposes of illustration and description. It is not intended to be exhaustive or to limit the technology to the precise form disclosed. Many modifications and variations are possible in the light of the above teaching. The described embodiments were chosen in order to best explain the principles of the technology and its practical application, to thereby enable others skilled in the art to best utilise the technology in various embodiments and with various modifications as are suited to the particular use contemplated. It is intended that the scope be defined by the claims appended hereto.

What is claimed is:

1. A method of processing frames for provision on an electronic display, comprising:

generating by processing circuitry frames to be displayed;

performing by processing circuitry a display modification operation on the generated frames to provide output frames for display, wherein said display modification operation comprises adjusting data values at data positions in the generated frames; and before the display modification operation is performed on a generated frame:

using by processing circuitry information about the display modification operation to be applied to the generated frame to be displayed to provide an output frame for display, to control an aspect of the generation of a frame to be displayed;

wherein using information about the display modification operation to control an aspect of the generation of a frame to be displayed comprises:

using information about how the data values in a generated frame to be displayed will be adjusted by the display modification operation to be applied to the generated frame to set or modify data values at data positions in the frame being generated.

2. The method of claim 1, wherein the frame to be displayed is a frame generated by a graphics processor, a frame generated by a video processor, or a frame generated by a composition engine.

3. The method of claim 1, wherein the display modification operation comprises a luminance compensation operation or a display modification operation that is based on an ambient light level.

4. The method of claim 1, wherein the display modification information comprises at least one of the following:

information that is indicative of and/or that can be used to determine how the data values for the data positions in the generated frame to be displayed will be changed by the display modification operation that will be used to generate the output frame that is provided for display from the generated frame; and one or more luminance scaling parameters to be used for the generated frame when it is subjected to the display modification operation.

5. The method of claim 1, wherein using information about the display modification operation to be applied to a generated frame to be displayed to provide an output frame for display, to control an aspect of the generation of a frame to be displayed comprises:

using by the processing circuitry information about the display modification operation applied to a preceding frame or frames to provide a preceding output frame or frames, to control an aspect or aspects of the generation of a subsequent frame or frames to be displayed.

6. The method of claim 1, comprising providing by the processing circuitry display modification information to one or more of: a graphics processing system, a video processing system, a frame compositing system, and a compression stage that operates to compress the generated frames before they are stored in a memory from which they are then read for the display modification operation.

7. The method of claim 1, comprising using by the processing circuitry the information about the display modification operation that is being applied to do at least one of the following:

identify data positions within the frame that will be set to a common value as a result of the display modification operation, and then setting the identified data positions to a same common value in the generated data frame; and quantise the data values within the frame being generated.

8. The method of claim 1 comprising:

compositing by the processing circuitry the frame to be displayed from two or more source frames;

and, based on the blending mode to be used for compositing the frames:

either modifying the frame data of the source frames based on the display modification information before the compositing process, or not modifying the frame data of the source frames based on the display modification information but modifying the frame data of the composited frame based on the display modification information.

9. The method of claim 1, comprising:

selecting by the processing circuitry the compression scheme to be used to compress data representing the generated frame based on the display modification information.

10. A system for processing frames for provision on an electronic display, the system comprising:

frame generation circuitry that generates frames to be displayed; and display modification stage for circuitry that:

performs display modifications on generated frames to provide output frames for display, wherein said display modifications comprise adjusting data values at data positions in the generated frames; wherein:

the frame generation circuitry is further configured to, before the display modification operation is performed on the generated frame:

use information about the display modification to be applied to the generated frame to be displayed to provide an output frame for display, to control an aspect of the generation of a frame to be displayed;

wherein using information about the display modification to control an aspect of the generation of a frame to be displayed comprises:

using information about how the data values in a generated frame to be displayed will be adjusted by the display modification to be performed on the generated frame to set or modify data values at data positions in the frame being generated.

11. The system of claim 10, wherein the display modification operation comprises a luminance compensation operation or a display modification operation that is based on an ambient light level.

12. The system of claim 10, wherein the display modification information comprises at least one of the following:

information that is indicative of and/or that can be used to determine how the data values for the data positions in the generated frame to be displayed will be changed by the display modification operation that will be used to generate the output frame that is provided for display from the generated frame; and one or more luminance scaling parameters to be used for the generated frame when it is subjected to the display modification operation.

13. The system of claim 10, wherein the frame generation circuitry is further configured to:

use information about the display modification operation applied to a preceding frame or frames to provide a preceding output frame or frames, to control an aspect or aspects of the generation of a subsequent frame or frames to be displayed.

14. The system of claim 10, wherein display modification information is provided to one or more of: a graphics processing system, a video processing system, a frame compositing system, and a compression stage that operates to compress the generated frames before they are stored in a memory from which they are then read for the display modification operation.

15. The system of claim 10, wherein the frame generation stage circuitry is configured to use the information about the display modification operation that is being applied to do at least one of the following:

identify data positions within the frame that will be set to a common value as a result of the display modification operation, and then set the identified data positions to a same common value in the generated data frame; and quantise the data values within the frame being generated.

16. The system of claim 10, further comprising:

a composition circuitry that composites the frame to be displayed from two or more source frames; and wherein:

the frame generation circuitry is configured to:

either modify the frame data of the source frames based on the display modification information before the compositing process, or not modify the frame data of the source frames based on the display modification information but modify the frame data of the composited frame based on the display modification information, based on the blending mode to be used for compositing the frame.

17. The system of claim 10, wherein the frame generation circuitry includes flail compression circuitry and is configured to:

select the compression scheme to be used to compress data representing the generated frame based on the display modification information.

18. A non-transitory computer readable storage medium storing computer software code which when executing on at least one processor performs a method of processing frames for provision on an electronic display, comprising:

generating by processing circuitry frames to be displayed;

performing by processing circuitry a display modification operation on the generated frames to provide output frames for display, wherein said display modification operation comprises adjusting data values at data positions in the generated frames; and before the display modification operation is performed on the generated frame:

using by processing circuitry information about the display modification operation to be applied to the generated frame to be displayed to provide an output frame for display, to control an aspect of the generation of a frame to be displayed;

wherein using information about the display modification operation to control an aspect of the generation of a frame to be displayed comprises:

using information about how the data values in a generated frame to be displayed will be adjusted by the display modification operation to be applied to the generated frame to set or modify data values at data positions in the frame being generated.

* * * * *